US005408255A

United States Patent [19]

Emerson

[11] Patent Number: 5,408,255

[45] Date of Patent: Apr. 18, 1995

[54] METHOD AND APPARATUS FOR ON LINE PHASING OF MULTI-NOZZLE INK JET PRINTHEADS

[75] Inventor: John K. Emerson, Elgin, Ill.

[73] Assignee: Videojet Systems International, Inc., Niles, Ill.

[21] Appl. No.: 977,111

[22] Filed: Nov. 16, 1992

[51] Int. Cl.[6] ..... B41J 2/115

[52] U.S. Cl. ..... 347/80; 347/78

[58] Field of Search ..... 347/80, 78, 79

[56] References Cited

U.S. PATENT DOCUMENTS

| | | | |
|---|---|---|---|
| 3,750,191 | 7/1973 | Naylor, III . | |
| 3,999,188 | 12/1976 | Yamada . | |
| 4,007,463 | 2/1977 | Fujimoto et al. | 347/80 |
| 4,012,745 | 3/1977 | Brown et al. | 347/80 |
| 4,025,926 | 5/1977 | Fujimoto et al. | 347/80 |
| 4,080,606 | 3/1978 | Yamada | 347/80 |
| 4,129,875 | 12/1978 | Ito et al. | 347/80 |
| 4,288,796 | 9/1981 | Aiba et al. | 347/80 |
| 4,308,543 | 12/1981 | Shultz . | |
| 4,364,061 | 12/1982 | Horike et al. . | |
| 4,420,761 | 12/1983 | Kitamura . | |
| 4,470,052 | 9/1984 | Lovelady | 347/80 |
| 4,524,366 | 6/1985 | Yamada | 347/80 |
| 4,616,234 | 10/1986 | Wint . | |
| 4,695,848 | 9/1987 | Padalino | 347/80 |
| 4,972,201 | 11/1990 | Katerberg et al. . | |
| 4,999,644 | 3/1991 | Katerberg et al. . | |

FOREIGN PATENT DOCUMENTS

| | | |
|---|---|---|
| 52-004124 | 1/1977 | Japan . |
| 58-158266 | 9/1983 | Japan . |
| WO89/00504 | 1/1989 | WIPO . |
| WO89/02829 | 4/1989 | WIPO . |

OTHER PUBLICATIONS

IBM Technical Disclosure, Avoiding Partial Charges on Droplets in a Binary Ink Jet Printer, A. L. Mix and D. A. VanHook, Jul., 1977.

IBM Research Disclosure, Phase Measurement for Ink Jet Printer, Gary J. Smith, Robert B. McJohnson and Jeffrey M. Williams, Jan., 1983.

*Primary Examiner*—R. L. Moses

*Attorney, Agent, or Firm*—Rockey, Rifkin and Ryther

[57] ABSTRACT

A pilot nozzle is provided for a multi-jet printing head. The pilot nozzle is continuously monitored to detect changes in phase due to changes in ink temperature, viscosity, pressure or other reason. Should a change occur requiring that the pilot nozzle be operated on a different clock phase, this change is made to all of the nozzles, without interrupting printing. The pilot nozzle is not used for printing, but is continuously monitored for the sole purpose of detecting phase changes.

9 Claims, 5 Drawing Sheets

METHOD AND APPARATUS FOR ON LINE PHASING OF MULTI-NOZZLE INK JET PRINTHEADS

BACKGROUND OF THE INVENTION

This invention relates to ink jet printing. More specifically, it relates to printing using multiple nozzle, continuous drop printers in which a plurality of ink jets are provided in an array. In order to operate the nozzles, it is necessary to correctly phase the jet streams before printing. This is accomplished in a setup or phasing mode of operation prior to the initiation of printing operation. Phasing is done by time shifting the charge pulse supplied to the charging electrode associated with each jet stream and measuring the charge induced on the ink drops. This data is used by the micro-processor based controller to optimize drop charging.

Due to changes in operating temperature, ink viscosity, pressure, as well as other environmental factors, it has been necessary not only to phase the printing array before printing begins, but to periodically stop printing to rephase the array. Because such printers are typically used in high output environments, where it is necessary to maximize printing, this interruption for phasing purposes is undesirable. More specifically, such printers are often used to mark products on assembly lines and the like with date codes, product codes and similar information. The use of these printers on high speed assembly lines can be tolerated only if the printers are both reliable and capable of providing high quality marking over extended periods of operation under changing environmental conditions.

It is accordingly an object of the present invention to provide an improved method and apparatus which can avoid the need for periodic interruption of the printing process to rephasing the jets.

It is another object of the invention to provide a printing device which continuously monitors phasing during the printing operation and which is capable of adjusting phase to maintain optimal printing without interrupting printing.

A further object of the invention is to provide a separate pilot nozzle for a printer of the type described which continuously monitors changes in phase due to environmental factors, thereby to permit automatic correction as changes in phase occur.

These and other objects of the invention will be apparent from the remaining portion of the specification.

SUMMARY OF THE INVENTION

Figure 1A:
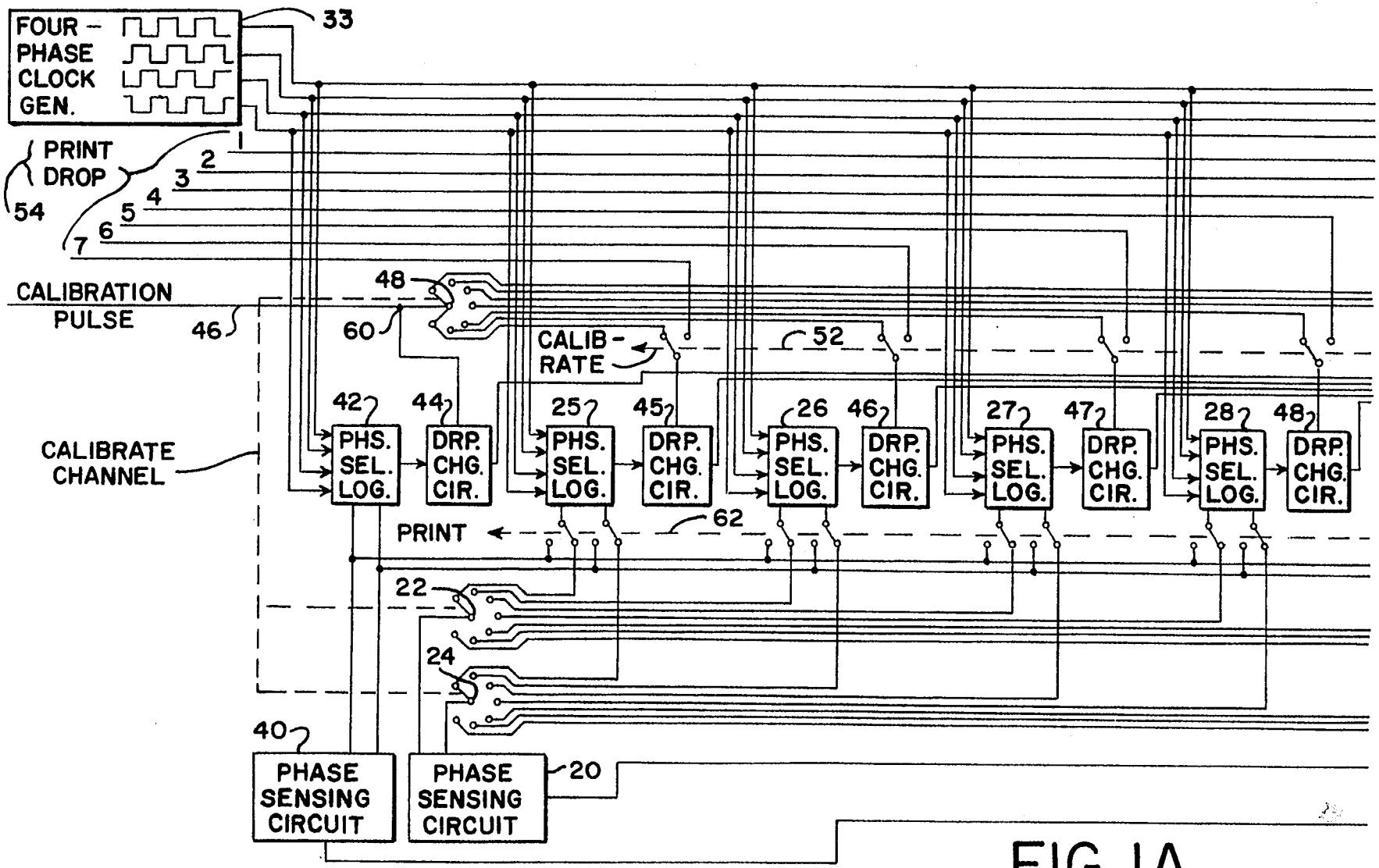
FIGS. 1A–1B are a schematic drawing illustrating a printer according to the invention in an embodiment employing a seven-high nozzle array with a separate pilot nozzle.
Figure 1B:
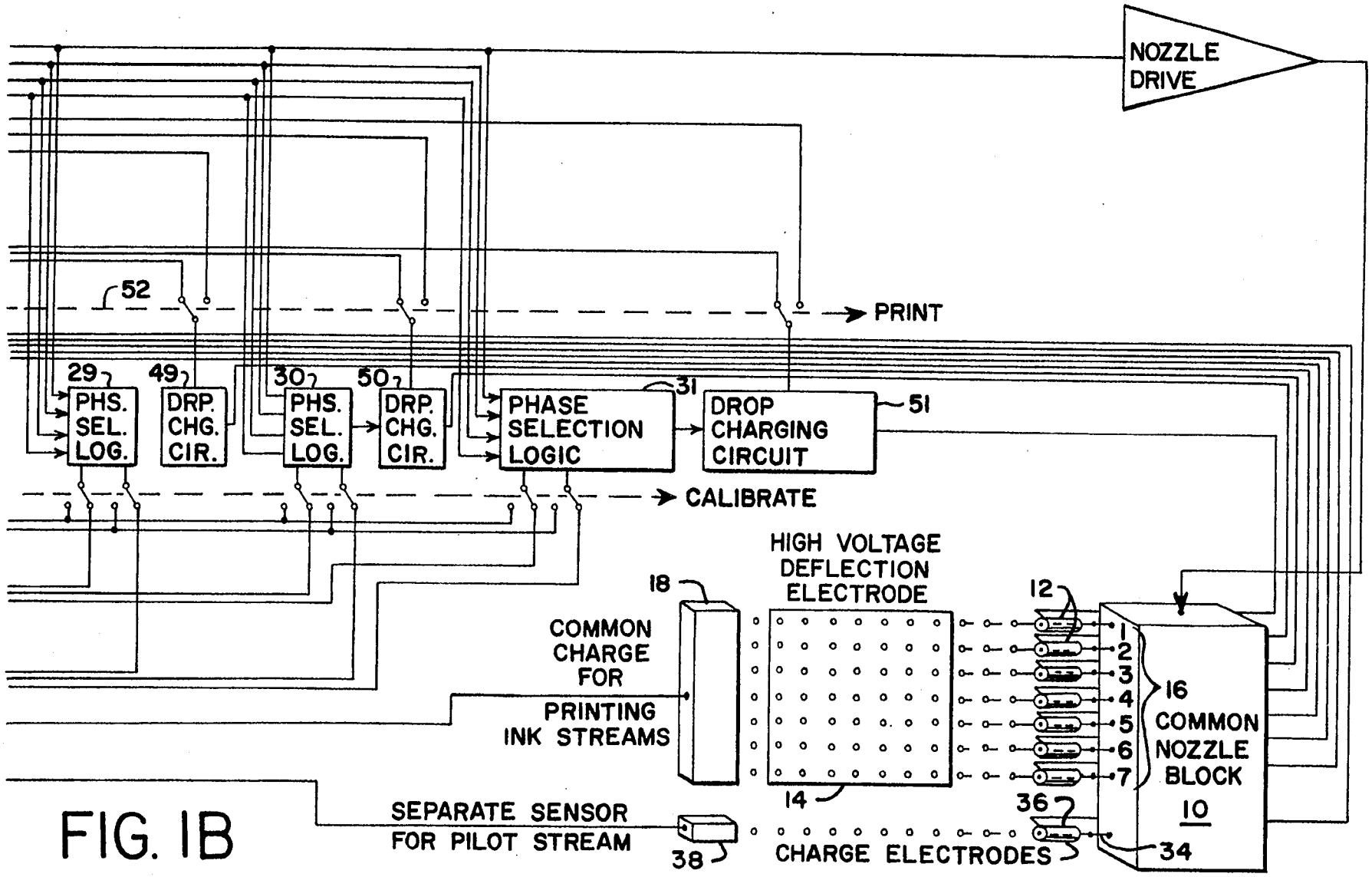

The present invention provides for continuous monitoring of the phase relationship between the drop charging signal and the break-off of drops from an ink stream in an ink jet printing system. The invention further provides for automatic correction of that relationship while printing. As a result, phasing can be accomplished without user intervention and continuous printing is permitted since phasing is accomplished without interruption. In addition, reduced system cost may be realized because less precision will be required to maintain ink pressure, temperature, viscosity and nozzle excitation voltages constant since variations therein can be tolerated and accounted for by the continuous monitoring of the printer phasing.

According to the invention a pilot nozzle, spaced slightly from the printing array of a typical nozzle block is employed. A separate charge electrode is provided for the pilot nozzle, along with a separate catcher and means for sensing the phase of the pilot ink stream separately from the streams which form the printing array. Circuit means are provided for detecting the phase of the pilot stream and for altering phase selection logic for the printing array based on changes detected in the pilot stream.

During system initialization, the correct drop break-off phase relationship for each jet in the printing array is established. The correct phase relationship for the pilot jet is also established at this time. During printing, the pilot jet is separately and continuously monitored. Its phase is continuously adjusted for optimum charging. The phase control for the jets in the printing array are linked to the pilot jet phase control circuits such that a change in the pilot jet phase is matched in magnitude and direction by a change in phase for the printing jets. This is successful to optimize printing because those factors which affect the phase of the pilot jet, i.e., variation in ink pressure, temperature, viscosity and nozzle excitation level, are common to the printing array and the pilot jet. Accordingly, they affect both the printing array and the pilot jet equally. Because the pilot jet used for phase monitoring is never used for printing, phase sensing and correction is permitted to occur continuously rather than at periodic intervals during which the printer must be taken off line.

DETAILED DESCRIPTION

Referring to the Figure, there is illustrated an embodiment of the invention. The invention will be described in connection with a seven high ink jet nozzle block, although of course a greater or lesser number of jets can be used. The invention will also be described in connection with the electro-mechanical switches shown in the Figure. It will be recognized, however, that in a preferred embodiment, these mechanical switches would be replaced with electronic switching circuits under control of the printers micro-processor.

A practical system might have one hundred or more printing nozzles, as opposed to the seven illustrated here for clarity. In such a case, it will be desirable to group the nozzles for phasing purposes rather than to phase each printing nozzle individually as described hereafter. Additionally, the circuit illustrated in the Figure, shows the print cycle being divided into four overlapping clock phases. It will be recognized by those skilled in this art that a larger number of clock phases may be employed. This permits the invention to maintain the phase closer to the theoretically perfect phase for each ink jet.

Referring now to the Figure, a nozzle block 10 is illustrated having seven printing nozzles 16 each emitting a stream of ink under pressure. As is well known in this art, by applying stimulation energy to the nozzles, the ink streams can be made to break up into discrete ink drops which can be electrically charged by a charge electrode 12. The drops next pass a high voltage deflection electrode 14 causing those which were charged to be deflected from their initial flight path onto a substrate or surface to be marked. Drops which are not charged by one of the charge electrodes 12, pass to a catcher and are returned to the ink system for reuse. Alternatively, the charged drops can pass to the catcher while the uncharged drops are used for printing.

For initial phasing purposes, the printing ink jets 16, are phased using a common charge sensor 18, the output of which is provided to a phase sensing circuit 20 (contact or capacitively coupled sensors are acceptable for this purpose). In turn, the phase sensing circuit is connected through switches 22 and 24 to phase selection logic circuits 25 through 31. Logic circuits 25 through 31 each correspond to one of the seven ink jet nozzles. Provided as inputs to the phase selection logic circuits 25 through 31 are inputs from a multi-phase clock generator 33. As can be seen from the Figure, for a four phase clock, each phase is separated by approximately ninety degrees. During set up each of the phase selection circuits 25–31 is employed to select the clock phase for its corresponding jet: which produces the best printing results. Thereafter, the circuits 25–31 are not used. Instead, phase control is provided as a function of the pilot nozzle and its separate phase sensing circuit 40 and selection logic 42.

More specifically, according to the present invention, in addition to the seven printing nozzles 16, there is provided a separate pilot nozzle 34, having a charge electrode 36 and a charge sensor 38, separate from the common charge sensor 18. Note, that since the pilot jet is employed solely for phase control, there is no need for it to be in operative relation with the deflection electrode 14. It is only necessary that the pilot nozzle be mounted to the same nozzle block as the printing nozzles, that it is subject to the same environmental conditions such as temperature variation, vibration and the like, and that it be supplied with the same ink and stimulating energy as the printing nozzles.

The output of sensor 38 is provided to a phase sensing circuit 40, which provides an input: to phase selection logic 42, dedicated to the pilot nozzle. As with the printing nozzles, the phase selection logic 42, controls a drop charging circuit 44, which functions to control operation of the specific charge electrode to which it is dedicated, in this case, the pilot electrode 36. Likewise, the printing nozzle charge electrodes 12 are controlled by drop charging circuits 45–51.

The phase selection logic simply chooses the clock phase to which the drop charging voltage will be synchronized. A digital multiplexer, such as a 74–139 is controlled by the controller to select one of the clock phases. The output of the multiplexer is then used to gate the charging voltage on and off.

During the setup or calibration mode, a calibration pulse 46 is provided to switch 48 to permit sequential calibration of each of the seven printing nozzles in a manner to be explained. The calibration pulse is applied to the drop charging circuits 45–51 corresponding to each of the seven printing nozzles. For that purpose, the switches indicated as being ganged by the dashed line 52, are moved to the calibrate position as shown in the Figure. In their alternate position, the gang switches connect the drop charging circuits 45–51 to the correct one of the seven drop printing signals illustrated by bracket 54 which is supplied from the print controller in a manner well known by those skilled in the art.

From the foregoing description the manner in which the present invention is intended to operate will be apparent. To ensure completeness of the disclosure, however, the following description of the system operation is provided. When the system is first powered up, it will enter the calibration or initialization mode. After an appropriate time has elapsed and the system has warmed up, the system controller will begin applying the calibration pulses 46, to nozzle 1 and to the pilot nozzle 34. Note that the switch 48 connects the drop charging circuit 51 (for the first nozzle) to the calibration pulse while the drop charging circuit 44 for the pilot nozzle is always connected thereto as indicated at 60. All four clock phases will be tested and the best one selected to maximize the induced charge or drops from the first nozzle. While there are many methods for phasing, most are reasonably compatible with the present invention. In that connection, reference is made to U.S. Pat. No. 3,750,119 to Naylor as an example of phasing techniques suitable for use in the invention.

As known by those skilled in the art, the correct phase for a nozzle is a function of the break-off point of the drops from the ink stream within the charge electrodes 12. Thus, in any array of nozzles there will be nozzle to nozzle variation in the dimensions and other physical characteristics of the nozzle causing small, but meaningful variation in the break-off point of drops. Unless the charge is applied at the right time, much of it will be lost. Hence the need for phasing each of the printing nozzles before commencing operation. After the first nozzle is phased, the selector switch 48 moves to the next position to begin phasing of nozzle two. This procedure is repeated until all seven nozzles have been initially phased.

Figure 2:
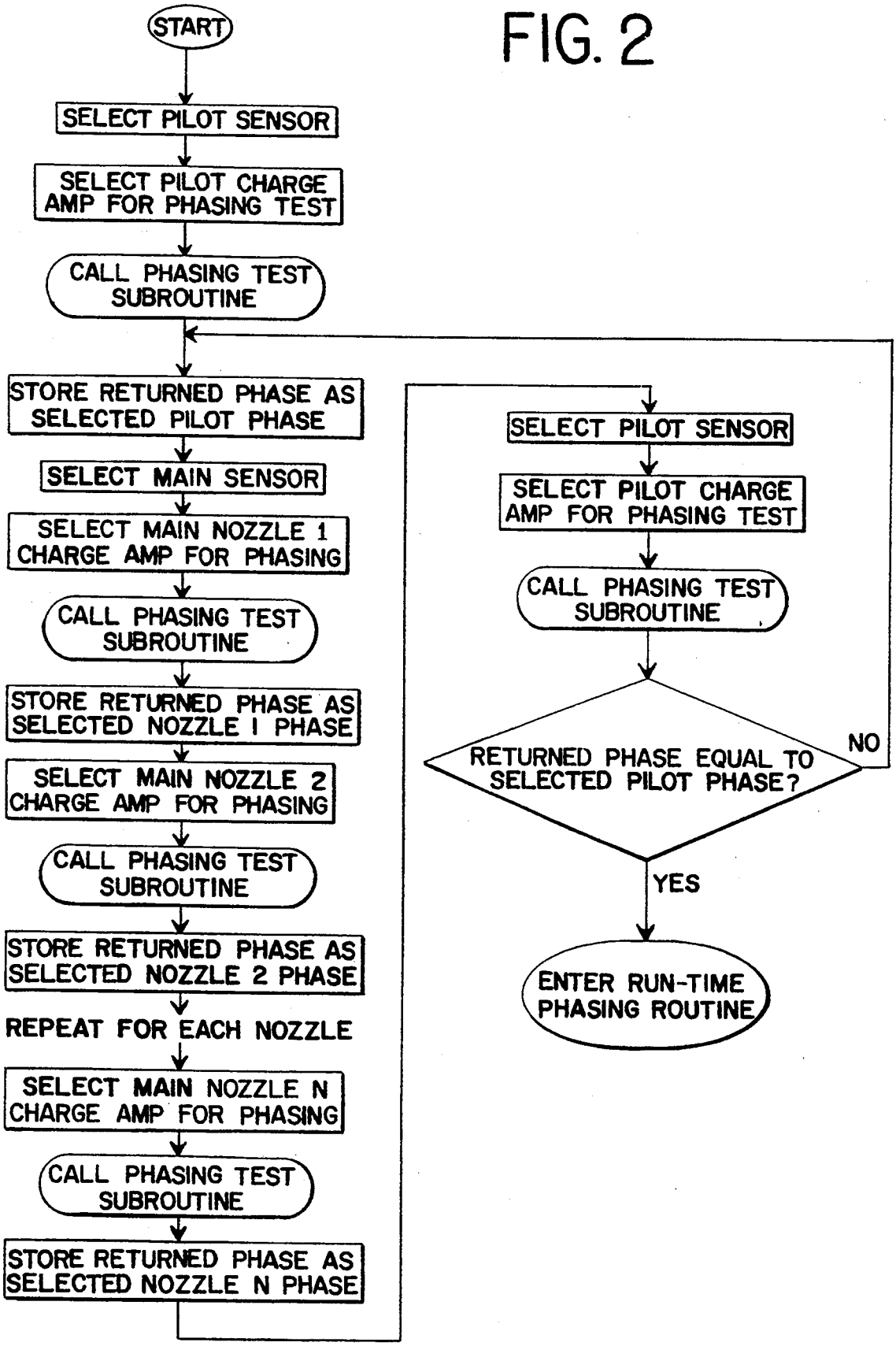
FIG. 2 is the initialization routine flow diagram.
Figure 3:
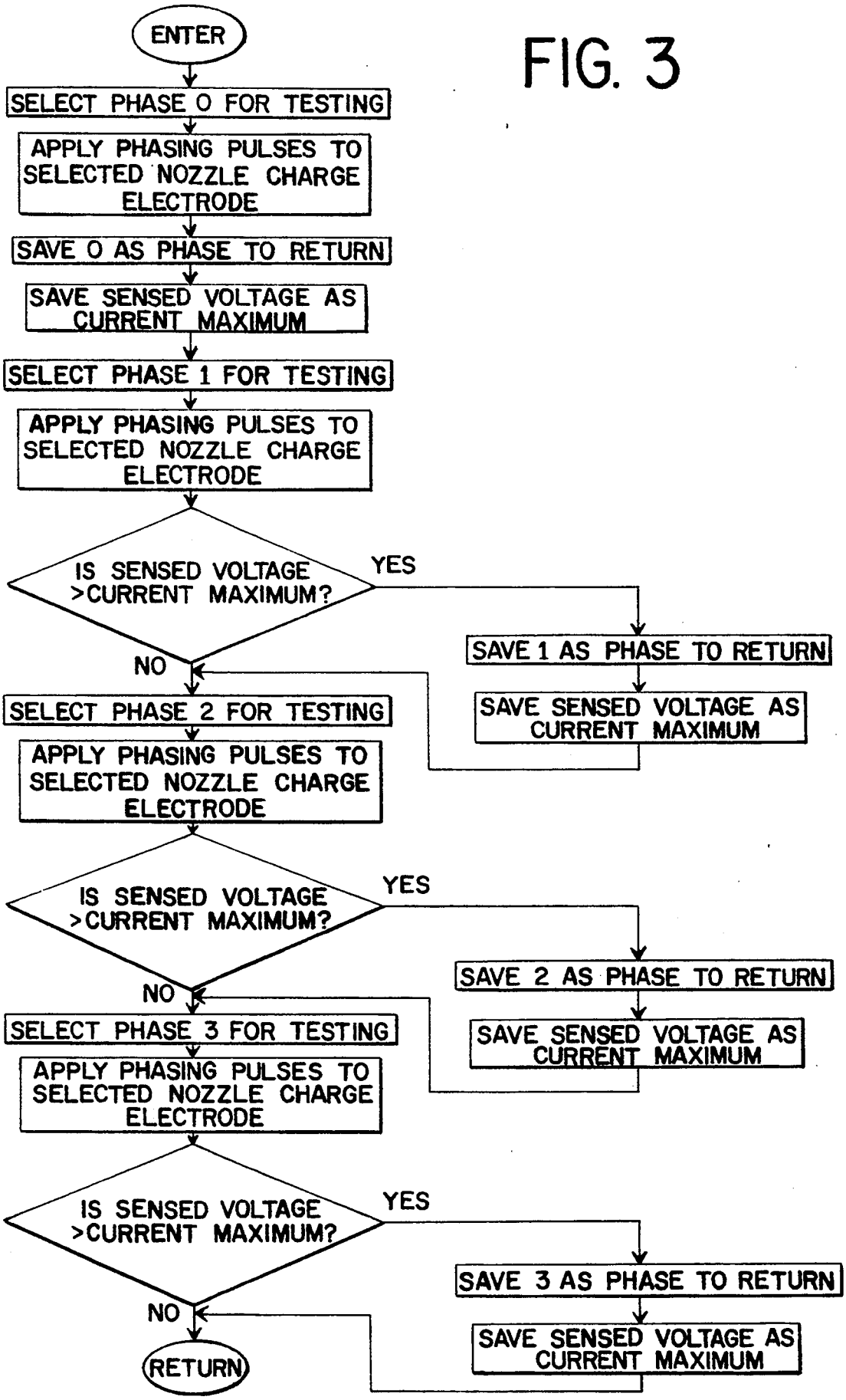
FIG. 3 is the phase test routine flow diagram.
Figure 4:
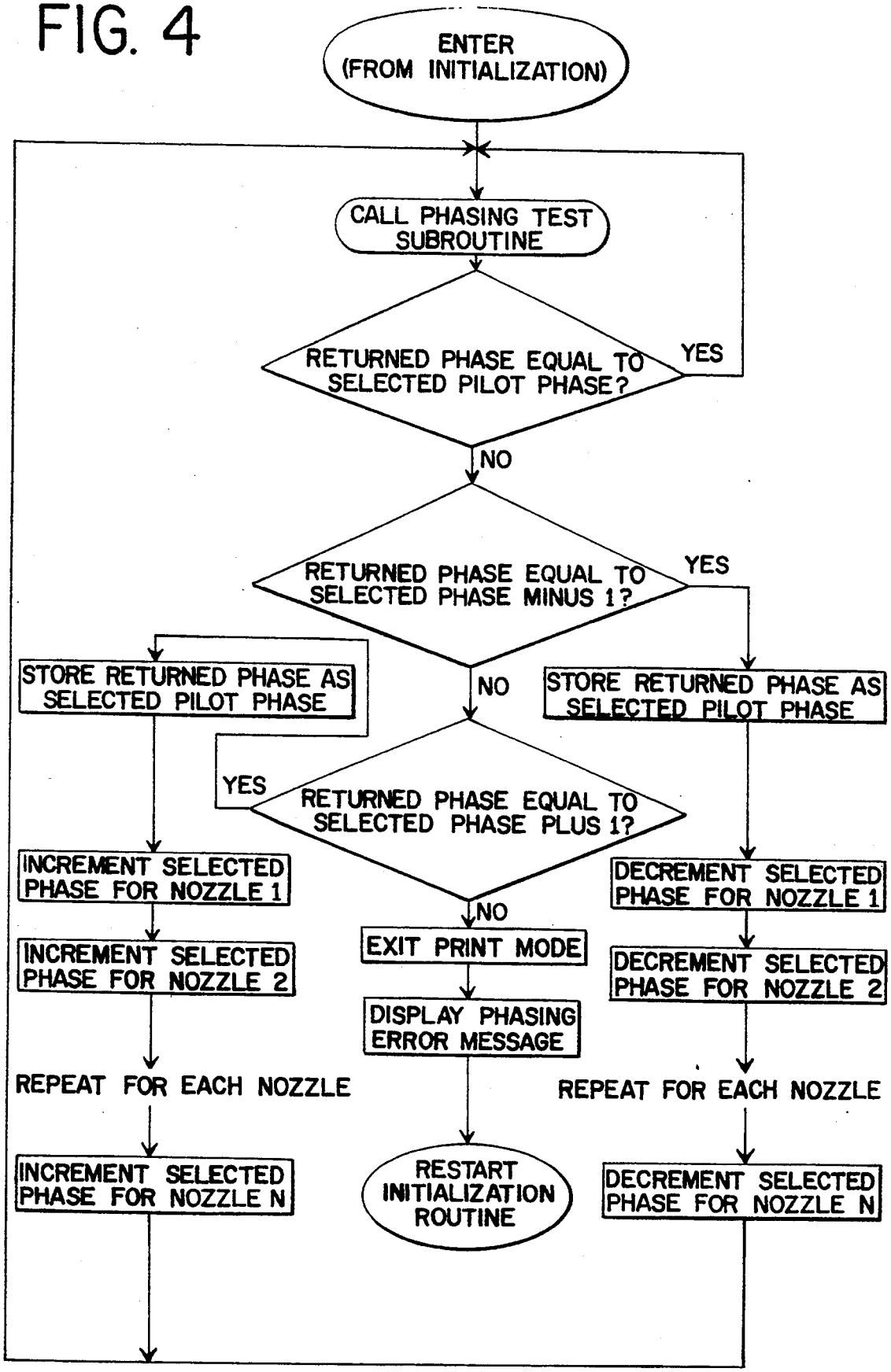
FIG. 4 is the run-time phasing flow diagram.

When all of the printing nozzles have been tested and their charging circuits set to the best phase, the pilot phase selection circuit 42 is rechecked to determine if the phase has drifted during the phase selection process for the printing nozzles. Note that the pilot nozzle is monitored continuously throughout the phase setting mode. If there has been a change in the phase of the pilot nozzle during this period, due to system warm-up or interaction between the nozzle streams, some of the initial nozzle phase settings may be wrong. Therefore, the entire procedure is repeated until there is no phase change occurring during the setup of the print nozzles. At that point, it may be safely assumed that the system is stable and that only gradual changes, due to temperature, pressure, viscosity or stimulation voltage variation need be expected. The system is then ready to enter the printing mode. FIGS. 2 and 3 illustrate the logic flow of the computer control during the initialization process. More specifically, FIG. 2 phases the pilot and print nozzles by repeatedly calling the phase test routine of FIG. 3 until it is satisfied that the phasing is correct and the printer is ready to enter the print mode (FIG. 4). These flow diagrams are self-explanatory, considered in view of the operating description provided herein and will not be further described.

To enter the printing mode, the switches 52 are moved from the calibrate position to the alternate position in which the drop charging circuits 45–51 are connected to the drop printing signals 54 from the controller. At this time, each of the seven nozzles has its phase set and locked on one of the four clock phases. This has been accomplished by the phase selection logic 25 through 31 which receive inputs from the charge sensor 18 and determines which of the four clock phases produce the best charge for a particular nozzle.

In addition to moving the switches 52 to the print mode, it is also necessary to disconnect charge sensor 18 and to couple the phase selection logic 25 through 31 to the output of phase sensing circuit 40 which monitors only sensor 38 corresponding to the pilot electrode. This is accomplished by shifting the position of the ganged switches indicated by dashed line 62. It will be seen that this switching permits all of the printing nozzles to be controlled by the sensor circuitry for the pilot nozzle 34.

In the print mode, the phase selection logic 25–31 for the printing jets is controlled solely by the phase sensing circuit 40 associated with the pilot jet 34. In a stable, properly operating system, phase changes are gradual. Accordingly, the pilot jet circuit need test only three phases: the phase currently used and the two adjacent phases, one earlier and one later. Should the earlier phase provide a better signal, the sensing circuit 40 signals the selection logic 25–31 and 42 to select an earlier phase as the new phase for each of the printing nozzles (and the pilot nozzle). Thus, all the printing nozzles operate in a master-slave relation with the pilot nozzle. Because the phase selection can be accomplished without sending calibration pulses to any of the printing jets, it is not necessary to interrupt printing in order to adjust phasing.

Similarly, if a later clock phase produces a better signal for the pilot jet, all of the printing jets will similarly be switched to a later clock phase. In this manner, continuous phase monitoring is accomplished and phase adjustments made on the fly without any interruption in the printing operation of the device. The phasing mode need only be employed once per day at the start up of the printer. Thereafter drift due to changes in operating conditions are automatically accounted for by virtue of the continuous monitoring of the pilot nozzle. The program flow diagram for the monitoring process is shown in FIG. 4.

As indicated in the beginning of this description, the electro-mechanical switches 22, 24, 48, 52 and 62 would be replaced, in a preferred embodiment, with electronically controlled switches under control of the system micro-processor. As also indicated, a greater or lesser number of printing nozzles can be used and nozzles can be grouped together for phasing rather than individually if desired. Also, a greater or lesser number of clock phases can be employed as desired for print optimization.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. In an ink jet printer having a plurality of print nozzles for emitting ink droplets therefrom, means for electrically charging selected print nozzle droplets using selected phases of a multi-phase clock, means for deflecting charged droplets onto a surface to be marked and means for collecting uncharged drops, the improvement comprising:

a) a pilot nozzle disposed in operative relation to said print nozzles for emitting ink droplets;

b) means for electrically charging selected pilot nozzle droplets using a selected phase of said multiphase clock;

c) means for monitoring the charges on said pilot nozzle droplets;

d) means for altering the pilot nozzle clock phase responsive to said monitoring means to maintain optimal charging of said pilot nozzle droplets;

e) means for coupling said altering means to the means for electrically charging the print nozzle droplets to alter the print nozzle clock phases as a function of pilot nozzle clock phase changes;

whereby variation in print nozzle operation due to temperature, ink pressure or ink viscosity changes is automatically compensated for without interrupting printing.

2. The printer of claim 1 wherein said means for monitoring includes means for detecting the charge induced on said pilot nozzle droplets.

3. The printer of claim 2 wherein said means for detecting includes a charge sensor.

4. An apparatus for controlling the clock phasing of the charging circuits for a multiple print nozzle ink jet printer, each nozzle charging circuit using preselected phases of a multiphase clock, said apparatus comprising:

a) a pilot nozzle disposed in operative relation to said print nozzles for emitting ink droplets;

b) a charging circuit for charging selected droplets emitted from said pilot nozzle using a preselected phase of said multi-phase clock;

c) means for monitoring the charges on said pilot nozzle droplets;

d) means for altering the pilot nozzle clock phase responsive to said monitoring means to maintain optimal charging of said pilot nozzle droplets;

e) means for coupling the charging circuits for the print nozzles to said altering means to alter the print nozzle clock phases as a function of pilot nozzle clock phase changes;

whereby environmental changes due to variation in operating temperature, ink pressure or ink viscosity are compensated for without interrupting printing.

5. The apparatus of claim 4 wherein said means for monitoring includes means for detecting the charge induced on said pilot nozzle droplets.

6. The apparatus of claim 5 wherein said means for detecting includes a charge sensor.

7. A method for controlling the clock phasing of charging circuits for a multiple print nozzle ink jet printer, each nozzle charging circuit using a preselected phase of a multi-phase clock, said method comprising the steps of:

a) emitting ink droplets from a pilot nozzle disposed in operative relation to said print nozzles;

b) charging selected droplets emitted from said pilot nozzle using a preselected phase of said multi-phase clock;

c) monitoring the charges on said pilot nozzle droplets;

d) altering the clock phase to maintain optimal charging of said pilot nozzle droplets;

e) altering the clock phases of the print nozzle charging circuits as a function of pilot nozzle clock phase changes;

whereby environmental changes due to variation in operating temperature, ink pressure or ink viscosity are compensated for without interrupting printing.

8. The method of claim 7 wherein the step of monitoring the pilot nozzle droplet charges includes sensing the magnitude of said charges.

9. The method of claim 7 wherein the step of altering the pilot nozzle clock phase includes the substeps of:

a) comparing at least the two adjacent clock phases with the current clock phase to determine which produces the best charge on said pilot nozzle droplets;

b) selecting the clock phase which produces the best charge.

* * * * *